US007187110B2

(12) United States Patent
Suzuki

(10) Patent No.: US 7,187,110 B2
(45) Date of Patent: Mar. 6, 2007

(54) SPARK PLUG

(75) Inventor: Takahiro Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/948,139

(22) Filed: Sep. 24, 2004

(65) Prior Publication Data

US 2005/0093415 A1 May 5, 2005

Related U.S. Application Data

(60) Provisional application No. 60/602,037, filed on Aug. 17, 2004.

(30) Foreign Application Priority Data

Sep. 27, 2003 (JP) ..... P.2003-373439

(51) Int. Cl.
*H01T 13/20* (2006.01)

(52) U.S. Cl. ..... 313/141; 313/139; 313/142; 313/143; 313/144; 445/7; 219/121.6; 219/121.61; 219/121.62; 219/121.63; 219/121.64

(58) Field of Classification Search ..... 313/139, 313/141, 142, 144, 143; 123/169 EL; 445/7; 219/121.6, 121.61, 121.62, 121.63, 121.64
See application file for complete search history.

(56) References Cited

U.S. PATENT DOCUMENTS 6,265,814 B1 * 7/2001 Yoshinaga et al. ..... 313/141
2001/0029916 A1 10/2001 Kanao
2002/0003389 A1 1/2002 Ishiguro
2002/0038992 A1 4/2002 Morita et al.
2002/0067111 A1 6/2002 Shibata et al.
2002/0105254 A1 8/2002 Hori et al.
2003/0038577 A1 2/2003 Hori et al.
2003/0155849 A1 8/2003 Hori
2003/0193282 A1 10/2003 Shibata et al.
2004/0041506 A1 * 3/2004 Teramura et el. ..... 313/141

FOREIGN PATENT DOCUMENTS

JP 56-153677 11/1981

* cited by examiner

*Primary Examiner*—Nimeshkumar D. Patel
*Assistant Examiner*—Anthony Canning
(74) *Attorney, Agent, or Firm*—Sughrue Mion, PLLC

(57) ABSTRACT

In a first embodiment a spark plug satisfying the relations: t≧0.3 mm and St/Sw≦7 in which t is the axial-direction shortest distance between a leading end surface 41*a* of a precious metal tip 41 and a joint portion 43, St is the surface area of the precious metal tip 41 and a joint portion 43 between the precious metal tip 41 and the ground electrode body 4*a*, and Sw is the area of the joint portion 43 between the ground electrode body 4*a* and the precious metal tip 41. In a second embodiment, the spark plug satisfies the relations t≧0.3 mm and La>Lb; and in a third embodiment the spark plug satisfies the relations t>T and La>Lb, where T, La and Lb are as defined in the specification. The relation t≧0.3 mm is specific to the first and second embodiments, and the relation St/Sw≦7 is specific to the first embodiment only.

20 Claims, 6 Drawing Sheets

SPARK PLUG

CROSS REFERENCE TO RELATED APPLICATIONS

This application claims benefit of U.S. Provisional Application No. 60/602,037 filed Aug. 17, 2004, incorporated herein by reference.

BACKGROUND OF THE INVENTION

1. Field of the Invention

The present invention relates to a spark plug used for ignition of an internal combustion engine.

2. Description of the Related Art

As for spark plugs used for ignition of an internal combustion engine such as an automobile engine, many spark plugs of the type having a center electrode formed to protrude from a leading end of a metal shell have been proposed, as compared with a conventional spark plug. This is for the following reason. Generally, when this type spark plug is attached to an internal combustion engine such as an automobile engine, a spark discharge gap formed between the center electrode and a ground electrode is provided inside a combustion chamber. Consequently, the ignitability of the spark plug can be improved (see Japanese Patent Laid-Open No. 153677/1981).

A large number of proposals have been also made for spark plugs of the type including a ground electrode having one end joined to a metal shell, and a precious metal tip bonded to the vicinity of the other end (the other end portion) of the ground electrode opposite the one end of the ground electrode. This is for the following reason. As described above, this type of spark plug is formed so that the spark discharge gap protrudes into the combustion chamber to improve ignitability of the spark plug. Accordingly, the ground electrode for forming the spark discharge gap is exposed to a high temperature (see Japanese Patent Laid-Open No. 2001-345162).

In the aforementioned spark plug, there is however a possibility that a spark generated in the spark discharge gap may be blown under the influence of a swirling flow or the like because the spark discharge gap is provided inside the combustion chamber, As a result, flying sparks may attack a joint portion between the ground electrode body and the precious metal tip because the spark shifts from a leading end surface of the precious metal tip. As a result, there is a possibility that the precious metal tip may drop out of or rather separate from the ground electrode body because the joint portion is worn out.

It is therefore effective to increase the axial-direction shortest distance between the joint portion and the leading end surface (opposite the center electrode) of the precious metal tip bonded to the ground electrode. According to this configuration, the spark can be caught in side surfaces of the tip even in the case where the spark is blown by the swirling flow. Accordingly, flying sparks can be prevented from attacking the joint portion, to prevent separation of the precious metal tip from the ground electrode body.

In a spark plug formed so that the axial-direction shortest distance between the joint portion and the leading end surface of the precious metal tip is increased as described above, the distance (hereinafter referred to as a protrusion height) between the leading end surface of the precious metal tip and the inner circumferential surface of the ground electrode body becomes large. In such spark plug, however, there is a possibility that the wear resistance of the precious metal tip will be lowered. This is because the heat capacity of the precious metal tip becomes so large that the precious metal tip assumes a high temperature.

SUMMARY OF THE INVENTION

It is therefore an object of the present invention to provide a spark plug having a protruding spark discharge gap and having a precious metal tip bonded to a ground electrode body and having a large protrusion height, in which the temperature assumed by the precious metal tip can be reduced to thereby prevent its wear resistance from being lowered.

The above object of the present invention has been achieved by providing a spark plug having: an insulator having an axial hole in an axial direction along an axis of said spark plug; a center electrode disposed in the axial hole of the insulator and On a leading end side of the axial hole; a metal shell surrounding the insulator, and a ground electrode including a ground electrode body having one end joined to the metal shell, and a precious metal tip bonded to the other end portion of the ground electrode body through a joint portion and disposed opposite the center electrode to form a spark discharge gap between the center electrode and the ground electrode, wherein the spark plug satisfies the relations: $t \geqq 0.3$ mm, and $St/Sw \leqq 7$ in which t is an axial-direction shortest distance between a leading end surface of the precious metal tip and the joint portion, St is a surface area of the precious metal tip and the joint portion, and Sw is an area of the precious metal tip and the joint portion as viewed from an inner circumferential surface of the ground electrode body.

The spark plug according to the invention is configured so that the axial-direction shortest distance t between the leading end surface of the precious metal tip and the joint portion is not smaller than 0.3 mm. When the axial-direction shortest distance t between the leading end surface of the precious metal tip and the joint portion is set to be not smaller than 0.3 mm, the axial-direction distance between the leading end surface of the precious metal tip and the joint portion between the precious metal tip and the ground electrode body can be sufficiently set. Accordingly, even when a spark is blown under the influence of a swirling flow or the like, flying sparks can be prevented from attacking the joint portion, to prevent separation of the precious metal tip from the ground electrode body. On the other hand, if the axial-direction shortest distance t between the leading end surface of the precious metal tip and the joint portion is smaller than 0.3 mm, there is a possibility that the precious metal tip will separate from the ground electrode body due to attack on the joint portion by flying sparks. In this case the effect of suppressing flying sparks from attacking the joint portion cannot be obtained.

Further, the spark plug according to the invention is configured so that the spark plug satisfies the relation: $St/Sw \leqq 7$ in which St is the surface area of the precious metal tip and the joint portion, and Sw is the area of the precious metal tip and the joint portion as viewed from the inner circumferential surface of the ground electrode body. When the axial-direction shortest distance between the precious metal tip and the joint portion is set to be not smaller than 0.3 mm as described above, the protrusion height of the precious metal tip from the joint portion becomes large. In a spark plug with such a large protrusion height, there is a possibility that the wear resistance of the precious metal tip may be lowered. This is because the heat capacity of the precious metal tip becomes so large that the precious metal tip assumes a high temperature. Therefore, when the spark plug according to the invention is configured so that the spark plug satisfies the relation: St/Sw≦7 in which St is the surface area of the precious metal tip and the joint portion, and Sw is the area of the precious metal tip and the joint portion, the quantity of heat received from combustible gas by the precious metal tip can be reduced sufficiently or heat received from combustible gas by the precious metal tip can be effectively transferred to the ground electrode body. Accordingly, the temperature of the precious metal tip can be restrained from becoming too high. As a result, the wear resistance of the precious metal tip is not deteriorated. On the other hand, if St/Sw is higher than 7, there is a possibility that the wear resistance of the precious metal tip is degraded because the precious metal tip assumes a high temperature as described above. More preferably, the spark plug satisfies the relation: St/Sw≦3.

As used herein, the "inner circumferential surface of the ground electrode body" means a surface of the ground electrode body on a side opposite the center electrode. The surface area St of the precious metal tip and the joint portion between the precious metal tip and the ground electrode body is the area of a surface which appears externally when viewing the precious metal tip bonded to the ground electrode body. Further, the area Sw of the precious metal tip and the joint portion when viewing the inner circumferential surface of the ground electrode body is the projected area of the precious metal tip and the joint portion when the precious metal tip and the joint portion are projected onto a virtual plane parallel to the inner circumferential surface of the ground electrode body.

Further, the spark plug according to the invention is configured so that the axial-direction distance Ls between a leading end of the metal shell and a leading end surface of the center electrode is not smaller than 3 mm. When the distance between the leading end surface of the center electrode and the leading end of the metal shell is thus set to be larger than that in the related art (in other words, when the center electrode is protruded), the ignitability of the spark plug can be improved. This is because a spark discharge gap formed between the center electrode and the ground electrode in the spark plug can be provided inside a combustion chamber under the condition that the spark plug is attached to an internal combustion engine such as an automobile engine Furthermore, if the axial-direction distance Ls between the leading end of the metal shell and the leading end surface of the center electrode is smaller than 3 mm, the effect of improving ignitability as described above cannot be obtained.

In the spark plug having a protruded center electrode as described above, there is a possibility that a spark generated in the spark discharge gap may be blown under the influence of a swirling flow or the like because the spark discharge gap is arranged inside the combustion chamber. As a result, there is a possibility that flying sparks may attack the joint portion between the ground electrode body and the precious metal tip because the spark shifts from the leading end surface of the precious metal tip. As a result, there is a possibility that the precious metal tip may separate from the ground electrode body because the joint portion is worn out.

However, when the relations: t≧0.3 mm and St/Sw≦7 are satisfied according to the invention, the joint portion can be effectively prevented from being worn out and the wear resistance of the precious metal tip per se can be prevented from being lowered even in the case where the spark plug is configured so that the center electrode protrudes as described above.

In the invention, the spark discharge gap preferably is not larger than 2 mm. If the spark plug gap is larger than 2 mm there is a concern that flashover, misfire, etc., may occur. Accordingly, when the spark plug gap is set to be not larger than 2 mm, a discharge voltage can be reduced so that electric discharge can be generated easily in the spark discharge gap.

Preferably, in the spark plug according to the invention, the relation: Sy/Sw≧1 is satisfied in which Sy is a minimum sectional area among sections taken perpendicularly to both the inner circumferential surface and an outer circumferential surface of the ground electrode body. Heat transfers from the precious metal tip to the ground electrode body, the metal shell and the engine head successively. That is, if the heat capacity of the ground electrode body is low, there is a possibility that the durability of the precious metal tip may be lowered because heat cannot be transferred from the precious metal tip to the metal shell. As a result, the metal shell cannot receive heat from the precious metal tip. Therefore, when the relation: Sy/Sw≧1 is satisfied in which Sy is the minimum sectional area among sections taken perpendicularly to both the inner circumferential surface and the outer circumferential surface of the ground electrode body, the durability of the precious metal tip can be prevented from being lowered because the heat received from the precious metal tip can be transferred to the metal shell effectively. If Sy/Sw is smaller than 1, there is a possibility that the aforementioned effect cannot be obtained.

The relation: Sy/Sw≧1 must be satisfied along the entire distance from the one end of the ground electrode to the joint portion.

Preferably, in the spark plug according to the invention, the precious metal tip is made of a material having a specific heat of not larger than 0.5 J/gdeg and a melting point of not lower than 1500° C. When the aforementioned precious metal tip is used, the durability of the precious metal tip can be fiber improved. Specific examples of the material of the precious metal tip include an Ir alloy and a Pt alloy.

Preferably, in the spark plug according to the invention, the joint portion is formed by laser welding the precious metal tip and the ground electrode body; and the length of the joint portion on one end side of the ground electrode is larger than the length of the joint portion on the other end side of the ground electrode as viewed from the inner circumferential surface of the ground electrode body. When the joint portion formed in this manner is longer on one end of the ground electrode, that is, on the side toward the metal shell, heat received by the precious metal tip can be effectively transferred to the metal shell.

An igniter portion on the center electrode side, as well as on the ground electrode side, is exposed to a high temperature. For this reason, a spark plug is known which further includes a second precious metal tip at a leading end of the center electrode In such a spark plug, the relation: t>T is preferably satisfied in which T is the axial-directional shortest distance between a leading end surface of the second precious metal tip and a second joint portion. In a general spark plug, the influence of a swirling flow or the like on a spark generated in the spark discharge gap is greater on the ground electrode side as compared with the center electrode side, so that there is a high possibility of shifting the spark from the leading end surface of the precious metal tip. That is, the tendency of flying sparks to attack the joint portion between the ground electrode body and the precious metal tip is higher than the tendency of flying sparks to attack the joint portion between the center electrode body and the second precious metal tip. Therefore, when the spark plug is configured according to the invention so that the axial-direction distance t between the leading end surface of the precious metal tip and the joint portion is larger than the axial-direction shortest distance T between the leading end surface of the second precious metal tip and the second joint portion, it is possible to reduce the tendency of flying sparks to attack the joint portion between the ground electrode body and the precious metal tip. Accordingly, also on the side of the ground electrode more easily damaged than the center electrode, such arrangement can prevent separation of the precious metal tip from the ground electrode body.

DESCRIPTION OF REFERENCE NUMERALS

Figure 1:
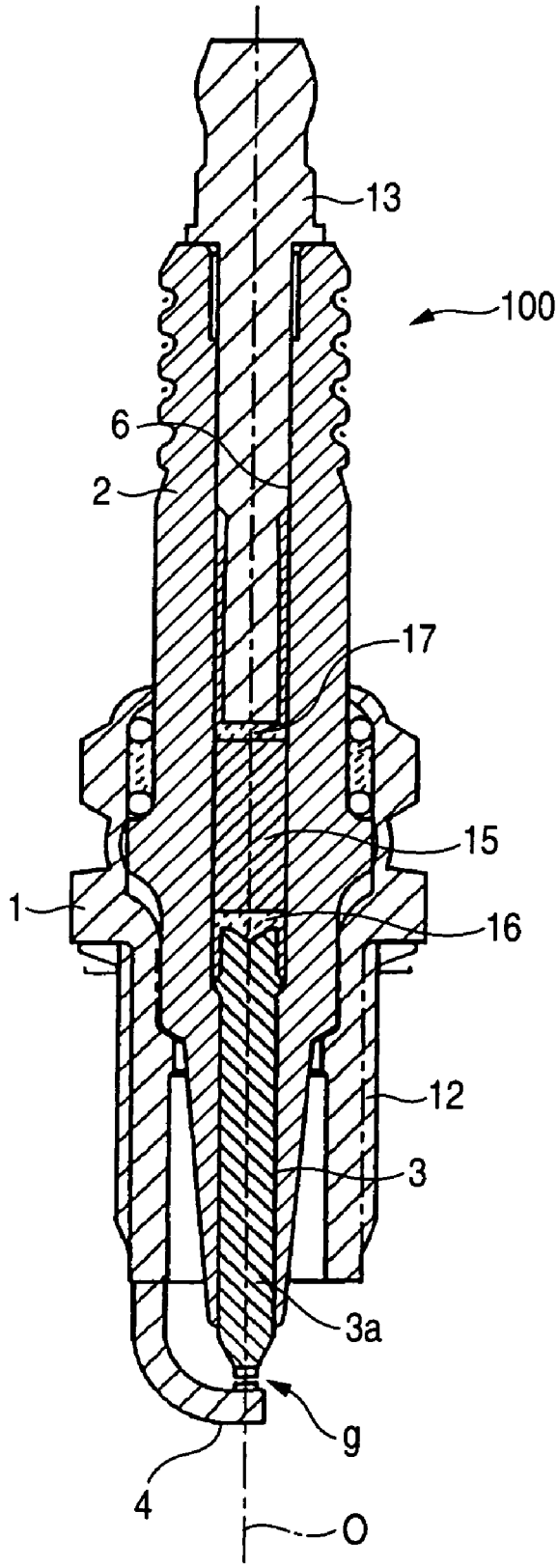
FIG. 1 is a front sectional view showing a spark plug 100 according to Embodiment 1 of the invention.

1: metal shell
2: insulator
3: center electrode
4: ground electrode
6: through-hole
31: precious metal tip
41; precious metal tip
100: spark plug
0: spark plug lengthwise axis

DETAILED DESCRIPTION OF THE INVENTION

The invention will now be described in greater detail with reference to the drawings. However, the present invention should not be construed as being limited thereto.

Figure 2:
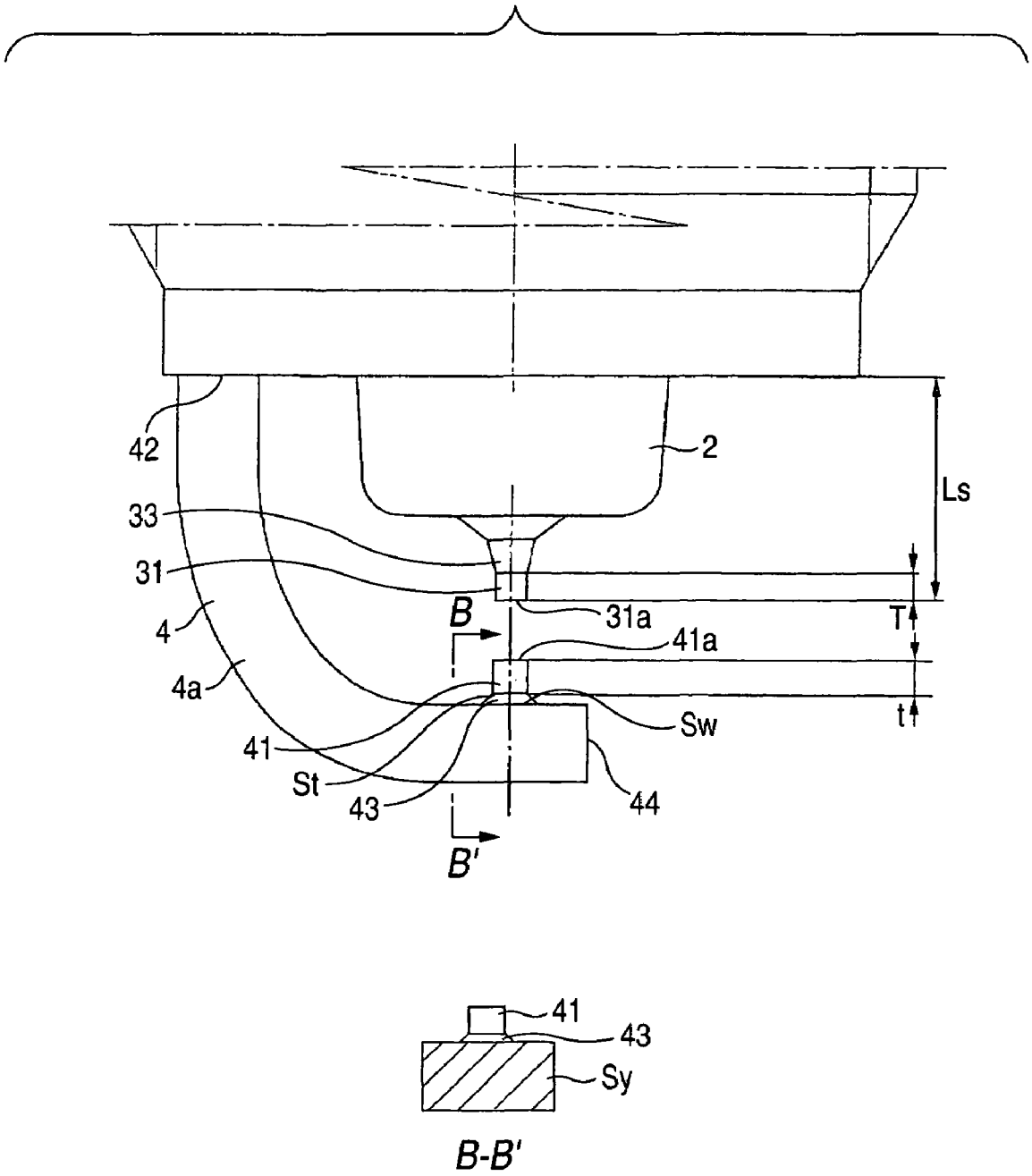
FIG. 2 is a front sectional view showing a main part of FIG. 1.
Figure 3:
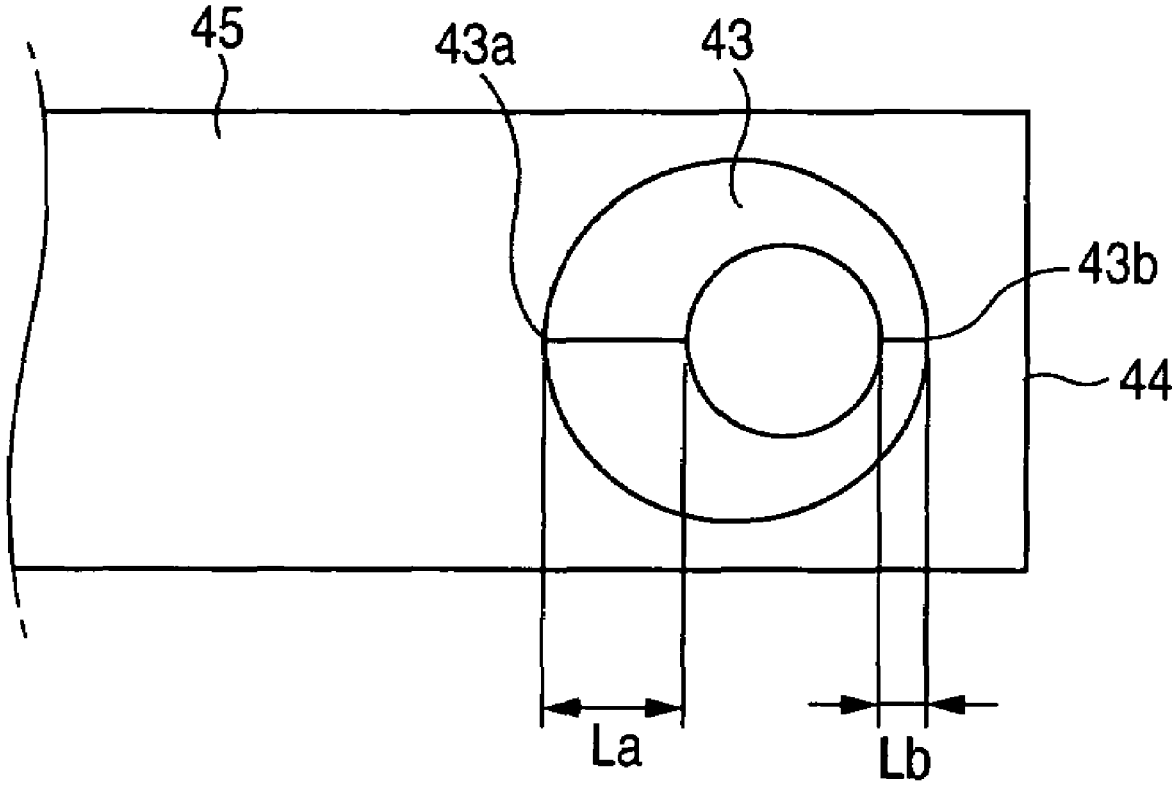
FIG. 3 is a front view of an inner circumferential surface 45 of a ground electrode body 4*a* depicted in FIG. 1.

FIGS. 1 to 3 show a resistor-containing spark plug 100 according to an embodiment of the invention. Ie resistor-containing spark plug 100 has a cylindrical metal shell 1, an insulator 2, a center electrode 3, and a ground electrode 4. The insulator 2 is fitted into the metal shell 1 so that a leading end portion of the insulator 2 protrudes from the metal shell 1. The center electrode 3 is provided inside the insulator 2 in a condition such that a precious metal tip 31 protrudes from the insulator 2. The ground electrode 4 has one end (rear end surface) 42 joined to the metal shell 1. A precious metal tip 41 is bonded to an inner circumferential surface 45 in the vicinity (the other end portion) of the other end (leading end surface) 44 of the ground electrode 4. The ground electrode 4 is bent so that a leading end surface 41*a* of the precious metal tip 41 is disposed opposite a leading end surface 31*a* of the precious metal tip 31. A spark gap g is formed between the precious metal tips 31 and 41.

The metal shell 1 is made of carbon steel or the like. As shown in FIG. 1, a threaded portion 12 is formed in the outer circumferential surface of the metal shell 1 so that the spark plug 100 can be attached to an engine block not shown. The insulator 2 is made of a ceramic sintered body such as alumina or aluminum nitride. The insulator 2 has a through-hole 6 formed therein so that the center electrode 3 can be fitted into the insulator 2 along the axial direction. A terminal attachment 13 is fixedly inserted into one end portion of the through-hole 6. Likewise, the center electrode 3 is fixedly inserted into the other end portion of the through-hole 6. A resistor 15 is disposed in the through-hole 6 and between the terminal attachment 13 and the center electrode 3. Opposite end portions of the resistor 15 are electrically connected to the center electrode 3 and the terminal attachment 13 via sealing layers 16 and 17 of electrically conductive glass, respectively.

The center electrode 3 is made of an Ni alloy such as INCONEL 600 (registered trademark of Inco Limited). While the diameter of the center electrode 3 is reduced toward its leading end side, a leading end surface 31*a* of the center electrode 3 is flattened. The precious metal tip 31 is formed on the leading end surface 31*a* of the center electrode 3 as follows. A disc-like or columnar precious metal tip is superposed on the leading end surface 31*a* of the center electrode 3 and bonded by means of laser welding, electron beam welding, resistance welding or the like along an outer edge portion of the joint surface of the center electrode 3. Thus, the precious metal tip 31 is formed. The precious metal tip 31 is made of metal containing Pt, Ir, and W as main components. Specifically, examples of the metal include: Pt alloys such as Pt—Ir and Pt—Rh; and Ir alloys such as Ir-5 wt % Pt, Ir-20 wt % Rh, Ir-5 wt % Pt-1 wt % Rh-1 wt % Ni and Ir-10 wt % Rh-5 wt % Ni. The precious metal tip 31 is not limited thereto. Other known precious metal tips may be appropriately used.

One end 42 of the ground electrode 4 is fixed to the leading end surface of the metal shell 1 by welding or the like so that the ground electrode 4 is integrated with the metal shell 1. On the other hand, the precious metal tip 41 is bonded to the inner circumferential surface 45 of the other end portion of a ground electrode body 4*a* so that the precious metal tip 41 is disposed opposite the leading end surface (specifically, the precious metal tip 31) of the center electrode 3. The precious metal tip 41 is formed as follows. A disc-like or columnar precious metal tip is provided in a predetermined position of the ground electrode 4 and fixed by means of laser welding, electron beam welding, resistance welding or the like. Thus, the precious metal tip 41 is formed. The electrode body 4*a* of the ground electrode 4 is made of INCONEL 600. The precious metal tip 41 is made of metal containing Pt, Ir and W as main components. Specifically, examples of the metal include: Pt alloys such as Pt-20 wt % Ni, Pt-20 wt % Rh and Pt-20 wt % Rh-5 wt % Ni; and Ir alloys such as Ir-5 wt % Pt, Ir-20 wt % Rh and Ir-11 wt % Ru-8 wt % Rh-1 wt % Ni. The precious metal tip 41 is not limited thereto. Other known precious metal tips may be appropriately used.

As described above, each of the precious metal tips 31 and 41 is made of an alloy of a material such as Ir or Pt, having a specific heat of 0.5 J/gdeg and a melting point of not lower than 1500° C. When the aforementioned precious metal tip is used, the durability of the precious metal tip can be further improved.

FIG. 2 additionally shows sectional area Sy along line B–B'.

As shown in FIG. 3, the joint portion (weld portion) 43 is formed so that the length (La in FIG. 3) of the joint portion 43 on one end 42 side of the ground electrode 4 is larger than the length (Lb in FIG. 3) of the joint portion 43 on the other end 44 side of the ground electrode 4 as viewed from the inner circumferential surface 45 of the ground electrode body 4*a*. When the joint portion 43 is formed to become longer toward one end 42 side of the ground electrode 4 in this manner, heat received by the precious metal tip 41 can be effectively transferred to the metal shell 1. Further, La (Lb) is the shortest distance from a side surface of the precious metal tip 41 to an outer edge point 43*a* (43*b*) of the joint portion 43. The outer edge point 43*a* is a point of the joint portion 43 nearest to one end 42 of the ground electrode (i e. nearest to the metal shell 1). The outer edge point 43*b* is a point of the joint portion 43 nearest to the other end (leading end surface) 44 of the ground electrode. In FIG. 3, the outer edge points 43*a*, 43*b* are located in the middle of the inner circumferential surface 45 of the ground electrode 4, but can be located away from the middle.

As shown in FIG. 2, the axial-direction shortest distance t between the leading end surface 41*a* of the precious metal tip 41 and the joint portion 43 is larger than the axial-direction shortest distance T between the leading end surface 31*a* of the second precious metal tip 31 and the second joint portion 33 (in this embodiment, t=0.45 mm, T=0.4 mm). Accordingly, this arrangement can prevent flying sparks from attacking the joint portion 43 between the ground electrode body 4*a* and the precious metal tip 41, so as not to damage the joint portion 43. Particularly, this arrangement can more effectively prevent separation of the precious metal tip 41 from the ground electrode body 4*a*.

EXAMPLES

Next, Examples 1 to 3 according to the invention will be described.

Example 1

Samples of the spark plug 100 having the shape shown in FIGS. 1 and 2 were prepared to examine the relationship between the length Ls in FIG. 2 and the ignition limit. Specifically, an evaluation was made to determine the chance of A/F (air/fuel) in accordance with the change of the length Ls. In each of the samples, sintered alumina ceramic, INCONEL 600, Ir-20 wt % Rh, and Pt-20 wt % Ni were selected as the materials of the insulator 2, an electrode body 3*a* of the center electrode 3, the precious metal tip 31 and the precious metal tip 41, respectively. The precious metal tip 31 was shaped in the form of a column having a height T of 0.4 mm and a diameter of ϕ 0.55 mm. The precious metal tip 41 was shaped in the form of a column having a height t of 0.45 mm and a diameter of ϕ 0.6 mm. The ground electrode body 4*a* was formed to have a width of 1.4 mm and a height of 2.5 mm. Further, the spark discharge gap was set at 1.1 mm. The precious metal tip 41 was bonded to the ground electrode body 4*a* by laser welding. The length La of the joint portion 43 on one end 42 side was 1.2 mm while the length Lb of the joint portion 43 on the other end 44 side was 0.4 mm. In order to effectively radiate heat to the metal shell 1, the length La of the joint portion 43 on one end 42 side was set to be not smaller than twice as large as the length Lb of the joint portion 43 on the other end 44 side.

Figure 4:
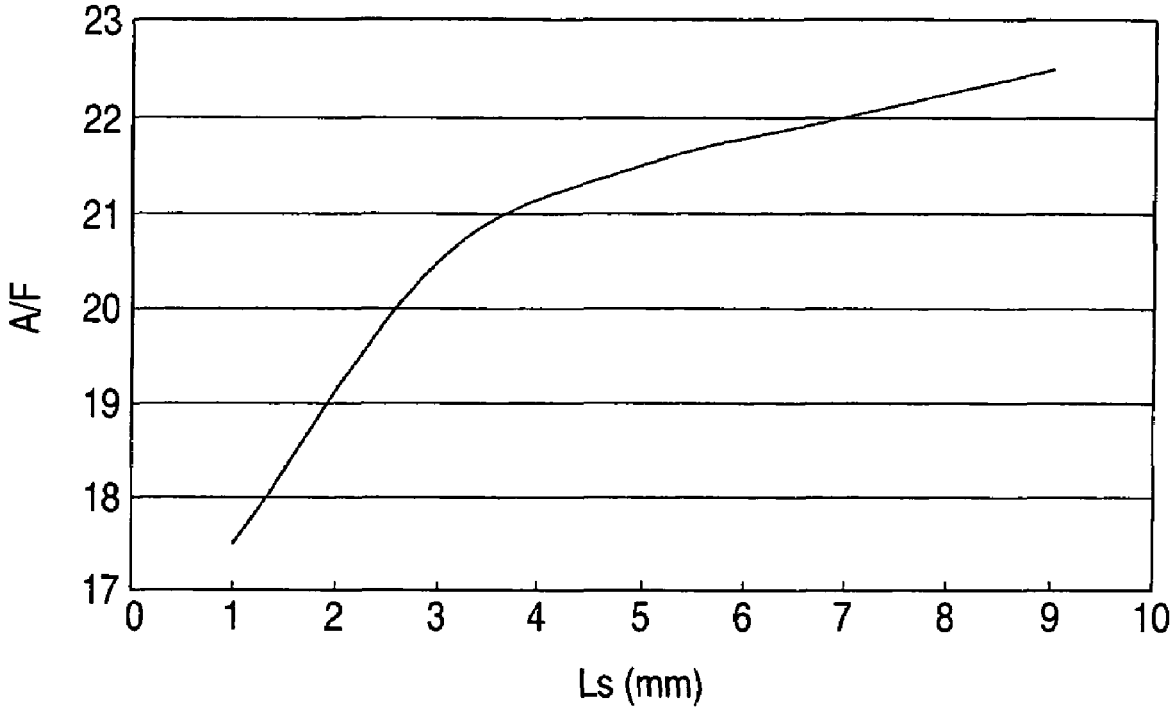
FIG. 4 is a graph showing results of an ignitability test conducted on the spark plug 100 according to Example 1.

The spark plug 100 set as described above was attached to a four-cylinder DOHC gasoline engine having a 1600 cc displacement. An ignitability test was performed on the spark plug 100 in a condition such that the suction pipe pressure was set at −350 mmHg. In this test, an HC spike method was used in the aforementioned engine condition, The examination was performed while a value at which ignition failure reached 1% of the whole ignition operations in the HC spike method was regarded as an ignition limit. According to this test, it has been found that the engine misfires when HC (hydrocarbon) is generated. FIG. 4 shows the results of the test.

As shown in FIG. 4, each of samples having Ls set to be not smaller than 3 mm exhibited a high A/F value of not smaller than 20 in the ignition limit, so that good ignitability could be obtained. On the other hand, each of samples having Ls set to be smaller than 3 mm exhibited an A/F value of smaller than 20, so that A/F decreased gradually as Ls approached 0 mm. That is, when the axial-direction distance Ls between the leading end of the metal shell 1 and the leading end surface 31*a* of the center electrode 3 is set to be not smaller than 3 mm, the center electrode 3 can be disposed so as to protrude from the metal shell 1. As a result, when the spark plug 100 is attached to an internal combustion engine such as an automobile engine, the spark discharge gap g formed between the center electrode 3 and the ground electrode 4 in the spark plug 100 can be provided inside a combustion chamber to thereby improve the ignitability of the spark plug 100.

Example 2

Next, samples of the spark plug 100 were prepared to examine the relationship between the distance t in FIG. 2 and the attack of flying sparks on the welded portion. Specifically, the spark plug 100 having the length Ls set at 4 mm was evaluated with respect to the change of the frequency of attack of flying sparks on the welded portion in accordance with a change in t In each of the samples, sintered alumina ceramic, INCONEL 600, Ir-20 wt % Rh and Pt-20 wt % Ni were selected as the materials of the insulator 2, the electrode body 3*a* of the center electrode 3, the precious metal tip 31 and the precious metal tip 41, respectively. The precious metal tip 41 was shaped in the form of a column having a diameter of ϕ 0.6 mm. The ground electrode body 4*a* was formed to have a width of 1.4 mm and a height of 2.5 mm. Further, the spark discharge gap was set at 1.1 mm.

Figure 5:
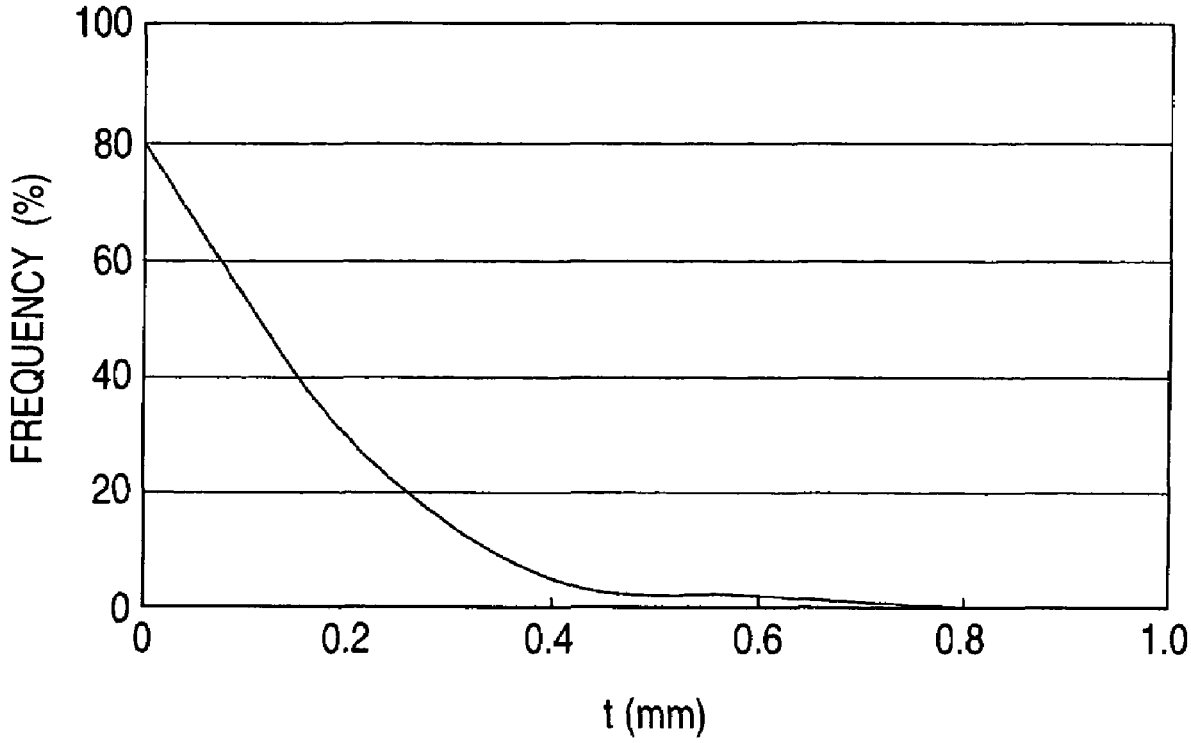
FIG. 5 is a graph showing results of frequency of attack of flying sparks on a welded portion in the spark plug 100 according to Example 2.

The spark plug 100 set as described above was attached to the inside of a pipe which simulated the inside of a combustion chamber of an engine. Under conditions of a flow rate of 8 mm/s, ignition coil energy of 40 mJ and pipe pressure of 0.4 MPa, an armchair test was performed to examine the frequency of attack of flying sparks on the welded portion. Specifically, the frequency of attack of flying sparks on the welded portion was examined while spark discharge was generated 500 times. FIG. 5 shows results of the test.

As shown in FIG. 5, in each of samples having the distance t set to be not smaller than 0.3 mm, the frequency of attack of flying sparks on the welded portion was lower than 20%. Each of these samples exhibited a low frequency of attack of flying sparks on the insulator. On the other hand, in each of samples having the distance t set to be smaller than 0.3 mm, the frequency of attack of flying sparks on the welded portion was not smaller than 20%, so that the frequency of attack of flying sparks on the welded portion increased gradually as the distance t approached 0 mm. That is, when the axial-direction shortest distance t between the leading end surface 41*a* of the precious metal tip 41 and the joint portion 43 is set to be not smaller than 0.3 mm, the frequency of attack of flying sparks on the joint portion 43 can be reduced to thereby reduce the possibility that the precious metal tip 41 will separate from the ground electrode body 4*a*.

Example 3

Next, samples of the spark plug 100 were prepared to examine the relationship between St and Sw. Specifically, the spark plug 100 in which the length Ls and the distance t in FIG. 2 were set at 4 mm and 0.45 mm respectively was evaluated to determine the change in temperature difference between the ground electrode body and the precious metal tip in accordance with a change in the ratio of St to Sw. In each of the samples, sintered alumina ceramic, INCONEL 600, Ir-20 wt % Rh and Pt-20 wt % Ni were selected as the materials of the insulator 2, the electrode body 3*a* of the center electrode 3, the precious metal tip 31 and the precious metal tip 41, respectively. The precious metal tip 41 was shaped in the form of a column having a diameter of ϕ 0.6 mm. The ground electrode body 4*a* was formed to have a width of 1.4 mm and a height of 2.5 mm. Further, the spark discharge gap was set at 1.1 mm.

Figure 6:
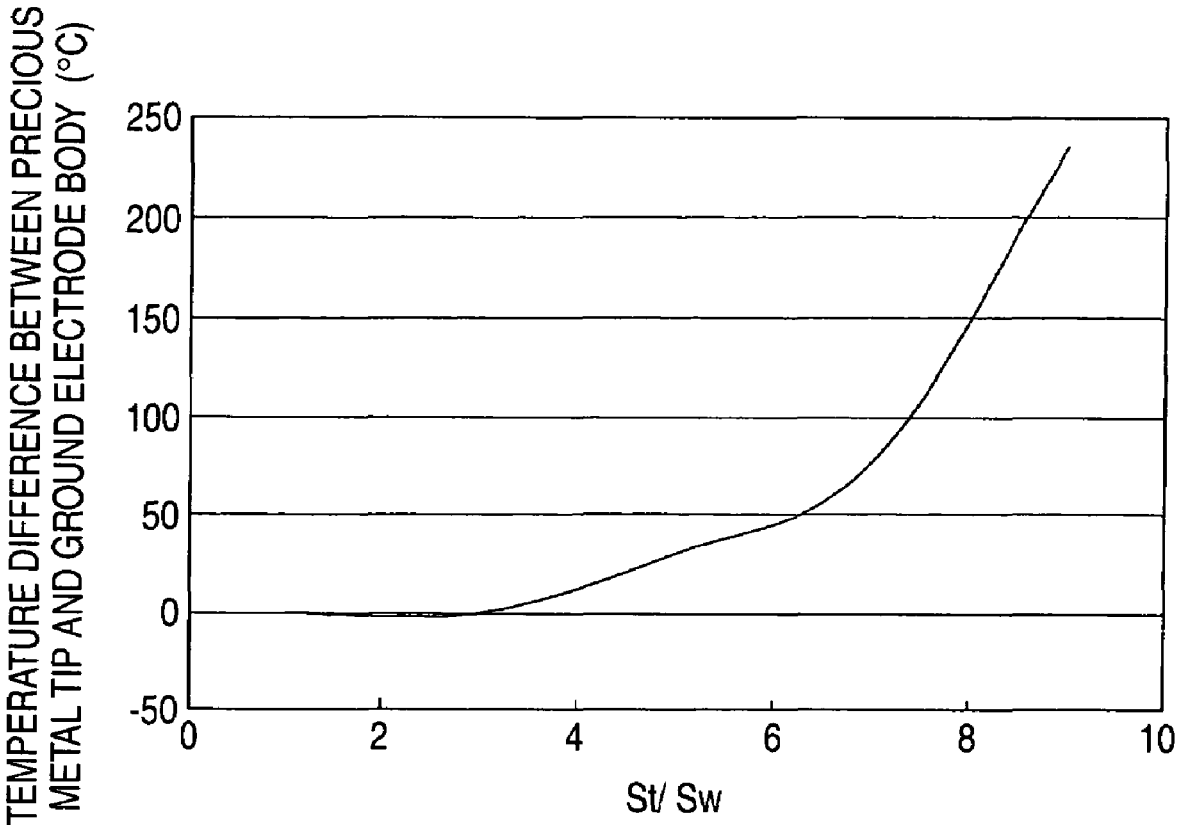
FIG. 6 is a graph showing results of the temperature difference between the ground electrode body 4*a* and a precious metal tip 41 in the spark plug 100 according to Example 3.

The spark plug 100 set as described above was attached to a four-cylinder DOHC gasoline engine having a 1600 cc displacement. The engine was operated in a full throttle condition at an engine rotational speed of 5600 rpm for a half hour. The respective temperatures of the ground electrode body 4*a* and the precious metal tip 41 in the spark plug 100 were measured to examine the temperature difference between the ground electrode body 4*a* and the precious metal tip 41. FIG. 6 shows the results of the test.

The area Sw of the precious metal tip and the joint portion was obtained as follows. An image of the inner circumferential surface 45 of the ground electrode body 4*a* (in the state shown in FIG. 3) was captured by a microscope (product name: digital microscope VHX-100 made by Keyence Corp.) with a 20-fold magnification. Points were taken at intervals of 0.1 mm. The area of the joint portion 43 surrounded by lines connecting the points was calculated as Sw. On the other hand, the surface area St of the precious metal tip 41 and the joint portion 43 was obtained as follows. First, a side surface of the ground electrode 4 (in the state shown in FIG. 2) was traced by a projector. The surface area of a portion (protrusive portion) protruding from the inner circumferential surface 45 of the ground electrode body 4*a* was calculated by CAD (computer aided design). The bottom area of the protrusive portion obtained by calculation was subtracted from the area Sw to thereby obtain the surface area of a portion (flat portion) of the joint portion which could not be measured from the side surface because the height of protrusion of the joint portion from the inner circumferential surface 45 of the ground electrode body 4*a* was too small. The surface area of the protruding portion and the surface area of the flat portion obtained in the aforementioned manner were added up to thereby obtain the sum as St.

As shown in FIG. 6, in each of samples having St/Sw set to be not larger than 7, the temperature difference between the ground electrode body 4*a* and the precious metal tip 41 was not larger than 80° C. That is, in each of these samples, there was a small temperature difference between the ground electrode body 4*a* and the precious metal tip 41. On the other hand, in each of samples having St/Sw set to be larger than 7, the temperature difference between the ground electrode body 4*a* and the precious metal tip 41 was larger than 80° C. In each of these samples, the temperature difference between the ground electrode body 4*a* and the precious metal tip 41 increased gradually as the value of St/Sw increased. That is, when the relation: St/Sw≦7 is satisfied in which St is the surface area of the precious metal tip 41 and the joint portion 43 between the precious metal tip 41 and the ground electrode body 4*a*, and Sw is the sum of the area of the precious metal tip 41 and the area of the joint portion 43 between the precious metal tip 41 and the ground electrode body 4*a* (when the inner circumferential surface 45 of the ground electrode body 4*a* is viewed from the leading end surface 41*a*), the quantity of heat received from combustible gas by the precious metal tip 41 can be sufficiently reduced or heat received from combustible gas by the precious metal tip 41 can be effectively transferred to the ground electrode body 4*a*. Accordingly, such arrangement can prevent the temperature of the precious metal tip 41 from rising, so that the wear resistance of the precious metal tip 41 is preserved.

Further, as shown in FIG. 6, in each of samples having St/Sw set to be not larger than 3, the temperature difference between the ground electrode body 4*a* and the precious metal tip 41 was not larger than 0° C. That is, in each of these samples, the temperature difference between the ground electrode body 4*a* and the precious metal tip 41 was very advantageous.

The invention is not limited to the specific embodiment and Examples 1 to 3. Various modifications may be made on the embodiment in accordance with purposes and applications within the spirit and scope of the invention. For example, in the spark plug 100 according to the invention, the precious metal tip 41 is not limited to one that is columnar shaped. The precious metal tip 41 have the shape of a cone, a prism or a pyramid.

In the spark plug 100 according to the invention, the center electrode 3 is not limited to one that is provided with the precious metal tip 31. For example, the center electrode 3 may be substituted with one not having a precious metal tip 31.

In the spark plug 100 according to the invention, the center electrode 3 or the ground electrode 4 is not limited to one that has only an electrode body. For example, the center electrode 3 may be formed as an electrode which has an electrode body formed as its surface, and a metal core that is embedded in the electrode body. The material of the metal core may be a metal such as Cu, Ag, etc. or an alloy of Cu, Ag, etc.

This application is based on Japanese Patent application JP 2003-373439, filed Sep. 27, 2003, the entire content of which is hereby incorporated by reference, the same as if set forth at length.

What is claimed is:

1. A spark plug comprising:

an insulator having an axial hole formed in an axial direction along an axis of said spark plug;

a center electrode disposed in said axial hole of said insulator and on a leading end side of said axial hole;

a metal shell surrounding said insulator; and a ground electrode including a ground electrode body having one end joined to said metal shell, and a precious metal columnar tip having a constant diameter bonded to the other end portion of said ground electrode body through a joint portion and disposed opposite said center electrode to form a spark discharge gap between said center electrode and said ground electrode, wherein said spark plug satisfies the relations:

$t \geqq 0.3$ mm, and $St/Sw \leqq 7$ in which t is an axial-direction shortest distance between a leading end surface of said precious metal columnar tip and said joint portion, St is a surface area of said precious metal columnar tip and said joint portion, and Sw is an area of said precious metal columnar tip and said joint portion as viewed from an inner circumferential surface of said ground electrode body, wherein said joint portion is formed by laser welding of said precious metal tip and said ground electrode body; and a radial length of La of said joint portion on one end side of said ground electrode is larger than a radial length of Lb of said joint portion on another end side of said ground electrode as viewed from said inner circumferential surface of said ground electrode body.

2. The spark plug as claimed in claim 1, which satisfies the relation:

$$Ls \geqq 3 \text{ mm}$$

wherein Ls is an axial-direction distance between a leading end of said metal shell and a leading end surface of said center electrode.

3. The spark plug as claimed in claim 1, which satisfies the relation:

$$Sy/Sw \geqq 1$$

wherein Sy is a minimum cross-sectional area selected from cross-sectional areas taken perpendicularly to both said inner circumferential surface and an outer circumferential surface of said ground electrode body.

4. The spark plug as claimed in claim 1, wherein said precious metal tip is made of a material having a specific heat of not larger than 0.5 J/gdeg and a melting point of not lower than 1500° C.

5. The spark plug as claimed in claim 1, wherein said radial length La is not smaller than twice said radial length Lb.

6. The spark plug as claimed in claim 1, wherein:

said center electrode includes a second precious metal tip bonded to a leading end of said center electrode through a second joint portion; and said spark plug satisfies the relation:

$$t > T$$

in which T is an axial-directional shortest distance between a leading end surface of said second precious metal tip and said second joint portion.

7. The spark plug as claimed in claim 1, wherein said precious metal tip exclusive of the joint portion has an entirely columnar shape.

8. The spark plug as claimed in claim 1, wherein La is the radial length of the joint portion closest to the metal shell.

9. A spark plug comprising:

an insulator having an axial hole formed in an axial direction along an axis of said spark plug;

a center electrode disposed in said axial hole of said insulator and on a leading end side of said axial hole;

a metal shell surrounding said insulator; and a ground electrode including a ground electrode body having one end joined to said metal shell, and a precious metal columnar tip bonded to an inner circumferential surface near the other end portion of said ground electrode body through a joint portion and disposed opposite said center electrode to form a spark discharge gap between said center electrode and said ground electrode; wherein:

said spark plug satisfies the relation:

$$t \geqq 0.3 \text{ mm}$$

in which t is an axial-direction shortest distance between a leading end surface of said precious metal tip and said joint portion;

said joint portion is formed by laser welding of said precious metal columnar tip and said ground electrode body; and a radial length La of said joint portion on one end side of said ground electrode is larger than a radial length Lb of said joint portion on other end side of said ground electrode as viewed from said inner circumferential surface of said ground electrode body.

10. The spark plug as claimed in claim 9, wherein said precious metal tip contains at least one alloy selected from the group consisting of a Pt—Ni alloy, a Pt—Rh alloy and a Pt—Rh—Ni alloy.

11. The spark plug as claimed in claim 9, wherein said precious metal tip exclusive of the joint portion has an entirely columnar shape.

12. The spark plug as claimed in claim 9, wherein La is the radial length of the joint portion closest to the metal shell.

13. The spark plug as claimed in claim 9, wherein said precious metal columnar tip has a constant diameter.

14. A spark plug comprising:

an insulator having an axial hole formed in an axial direction along an axis of said spark plug;

a center electrode disposed in said axial hole of said insulator and on a leading end side of said axial hole and including a first precious metal columnar tip laser-welded to a leading end of said center electrode through a first joint portion;

a metal shell surrounding said insulator; and a ground electrode including a ground electrode body having one end joined to said metal shell, and a second precious metal tip bonded to an inner circumferential surface near other end of said ground electrode body through a second joint portion and disposed opposite said first precious metal columnar tip to form a spark discharge gap between said first precious metal columnar tip and said second precious metal tip, wherein:

said spark plug satisfies the relation:

$$t > T$$

in which T is an axial-direction shortest distance between a leading end surface of said first precious metal columnar tip and said first joint portion, and t is an axial-direction shortest distance between a leading end surface of said second precious metal tip and said second joint portion; and a radial length La of said second joint portion on one end side of said ground electrode is larger than a radial length Lb of said second joint portion on other end side of said ground electrode as viewed from said inner circumferential surface of said ground electrode body.

15. The spark plug as claimed in claim 14, wherein said first precious metal tip contains at least one alloy selected from the group consisting of an Ir—Pt alloy, an Ir—Rh alloy, an Ir—Rh—Ni alloy and an Ir—Pt—Rh—Ni alloy.

16. The spark plug as claimed in claim 14, wherein said second precious metal tip contains at least one alloy selected from the group consisting of a Pt—Ni alloy, a Pt—Rh alloy and a Pt—Rh—Ni alloy.

17. The spark plug as claimed in claim 14, which satisfies the relation:

$$St/Sw \geqq 7$$

wherein St is a surface area of said second precious metal tip and said second joint portion, and Sw is an area of said second precious metal tip and said second joint portion as viewed from said inner circumferential surface of said ground electrode body.

18. The spark plug as claimed in claim 14, wherein said precious metal tip of the ground electrode exclusive of the joint portion has an entirely columnar shape.

19. The spark plug as claimed in claim 14, wherein La is the radial length of the second joint portion closest to the metal shell.

20. The spark plug as claimed in claim 14, wherein said second precious metal columnar tip has a constant diameter.

* * * * *